US008323096B2

(12) United States Patent
Tomei

(10) Patent No.: US 8,323,096 B2
(45) Date of Patent: Dec. 4, 2012

(54) METHOD OF PROVIDING A SUPPLEMENTAL BINGO GAME

(75) Inventor: Vance Tomei, Charlottesville, VA (US)

(73) Assignee: Video Gaming Technologies, Inc., Franklin, TN (US)

( * ) Notice: Subject to any disclaimer, the term of this patent is extended or adjusted under 35 U.S.C. 154(b) by 159 days.

(21) Appl. No.: 12/829,688

(22) Filed: Jul. 2, 2010

(65) Prior Publication Data

US 2011/0009179 A1 Jan. 13, 2011

Related U.S. Application Data

(60) Provisional application No. 61/223,528, filed on Jul. 7, 2009.

(51) Int. Cl.
*A63F 9/24* (2006.01)

(52) U.S. Cl. ..... 463/22; 463/19

(58) Field of Classification Search ..... 463/19, 463/22

See application file for complete search history.

(56) References Cited

U.S. PATENT DOCUMENTS 4,332,389 A * 6/1982 Loyd et al. ..... 463/19
5,072,381 A * 12/1991 Richardson et al. ..... 463/19
6,132,312 A * 10/2000 Hecht ..... 463/19
6,837,793 B2 1/2005 McClintic
7,654,896 B2 2/2010 Baerlocher
7,690,977 B2 4/2010 Cuddy et al.
2002/0080960 A1* 6/2002 Kanayama et al. ..... 380/201
2003/0186739 A1 10/2003 Paulsen et al.
2003/0236115 A1 12/2003 Chamberlain
2005/0026669 A1 2/2005 Nelson et al.
2005/0164773 A1 7/2005 Lind et al.
2005/0255906 A1* 11/2005 Lind et al. ..... 463/19
2006/0121976 A1* 6/2006 Odom ..... 463/19
2007/0117608 A1 5/2007 Roper et al.
2007/0173311 A1* 7/2007 Morrow et al. ..... 463/16
2008/0045301 A1* 2/2008 Lind et al. ..... 463/19
2009/0069087 A1* 3/2009 Kelly et al. ..... 463/37
2009/0111564 A1* 4/2009 Smith et al. ..... 463/20

* cited by examiner

*Primary Examiner* — Arthur O. Hall
*Assistant Examiner* — Steve Rowland
(74) *Attorney, Agent, or Firm* — Howard & Howard Attorneys PLLC

(57) ABSTRACT

Systems and methods for providing a supplemental bingo game and produce supplemental bingo cards for use in a supplemental bingo game that can provide simultaneous winners. The bingo cards have a predetermined number of rows and columns forming a grid with a plurality of locations. Each location has an assigned bingo number. The numbers in one of the columns of one of the bingo cards are the same as the numbers in all of the other bingo cards, but arranged in a random order.

48 Claims, 6 Drawing Sheets

| B | I | N | G | O |
|---|---|---|---|---|
| 1 | 16 | 31 | 46 | 61 |
| 2 | 17 | 32 | 47 | 62 |
| 3 | 18 | 33 | 48 | 63 |
| 4 | 19 | 34 | 49 | 64 |
| 5 | 20 | 35 | 50 | 65 |

30A

| B | I | N | G | O |
|---|---|---|---|---|
| 5 | 20 | 35 | 50 | 65 |
| 4 | 19 | 34 | 49 | 64 |
| 3 | 18 | 33 | 48 | 63 |
| 2 | 17 | 32 | 47 | 62 |
| 1 | 16 | 31 | 46 | 61 |

30B

| B | I | N | G | O |
|---|---|---|---|---|
| 1 | 16 | 31 | 46 | 61 |
| 2 | 17 | 32 | 47 | 62 |
| 3 | 18 | 33 | 48 | 63 |
| 4 | 19 | 34 | 49 | 64 |
| 5 | 20 | 35 | 50 | 65 |

30A

*FIGURE 3A*

| B | I | N | G | O |
|---|---|---|---|---|
| 5 | 20 | 35 | 50 | 65 |
| 4 | 19 | 34 | 49 | 64 |
| 3 | 18 | 33 | 48 | 63 |
| 2 | 17 | 32 | 47 | 62 |
| 1 | 16 | 31 | 46 | 61 |

30B

*FIGURE 3B*

| B | I | N | G | O |
|---|---|---|---|---|
| 4 | 18 | 33 | 47 | 64 |
| 2 | 16 | 35 | 46 | 61 |
| 1 | 20 | 32 | 49 | 62 |
| 5 | 17 | 31 | 50 | 65 |
| 3 | 19 | 34 | 48 | 63 |

30C

*FIGURE 3C*

METHOD OF PROVIDING A SUPPLEMENTAL BINGO GAME

CROSS REFERENCE TO RELATED APPLICATIONS

This application claims priority to U.S. Provisional Patent Application 61/223,528 filed Jul. 7, 2009, which is hereby incorporated by reference.

FIELD OF THE INVENTION

The present invention relates generally to games, and more particularly, to a game having a supplemental bingo-type game.

BACKGROUND OF THE INVENTION

In some jurisdictions, wagering is permitted on certain types of games, e.g., Bingo, lotteries, pull-tabs, is allowed. The types of games may be electronic or table games, i.e., mechanical.

In one scenario, an electronic game, such as bingo, is provided in which players compete with and against each other. A minimum of two players is needed. Each player uses a player terminal which is inter-linked, e.g., via an Ethernet network, to a central server. To initiate the play of the game, a player inserts credits or coins, or currency into the player terminal. The coins or currency may be converted into credits. The number of credits are added to a credit meter and displayed on a display screen.

If the game being played is Bingo, the player selects the level of play by pressing a "bet" button to set the wager amount for a bingo card. The player may then initiate the bingo game by pressing a "play" button.

The server, after determining that enough players have entered the game, randomly determines a string of numbers and transmits the numbers to the player terminals. These are daubed, automatically or by the player, onto their card(s).

Each game has a defined game-ending pattern. As soon, as the string of numbers results in the game ending pattern for one of the players on one of the cards, the bingo game is over and no additional numbers are transmitted. The player with the game-ending or winning pattern is awarded a payout, in terms of credits, according to a pay table which may be traded in for cash.

These electronic games, however, may be presented as a different type of game, e.g., as a video slot machine. From the player's perspective, these type of electronic games play as video slot machines. In other words, to a player, the games operate much like a video slot machine, which is a solitary gaming experience. Thus, the community nature of the underlying bingo game is lost.

The present invention is aimed at one or more of the problems set forth above.

SUMMARY OF THE INVENTION

In a first aspect of the present invention, a method for providing a supplemental game to a plurality of players is provided. The supplemental game is associated with a main game and is in the form of a bingo game. The method includes the step of establishing a plurality of bingo cards for the supplemental bingo game. Each bingo card has a plurality of columns and a plurality of rows defining a grid with a plurality of locations. Each location has an assigned number. The numbers in each column are the same as the corresponding columns in the other bingo cards albeit arranged in a random order. The method includes the steps of assigning a supplemental bingo card to any player in the supplemental game, establishing a bingo ball draw of a predetermined number of bingo numbers, and comparing the bingo ball draw against the supplemental bingo cards associated with players and identifying any matches. The method further includes the step of awarding a supplemental award to any player whose associated supplemental bingo card includes a predefined interim matching pattern.

In a second aspect of the present invention, a method for providing a game to a plurality of players is provided. The game includes a main game and a supplemental game. The supplemental game is in the form of a bingo game. The method includes the steps of allowing the players to place a wager on the main game, playing the main game and establishing an outcome of the main game, and awarding one or more players an award as a function of the respective wager and the outcome of the main game. The method further includes the step of establishing a plurality of bingo cards for the supplemental bingo game. Each bingo card has a plurality of columns and a plurality of rows defining a grid having a plurality of locations. Each location has an assigned number. The numbers in each column being the same as the corresponding columns in the other bingo cards albeit arranged in a random order. The method also includes the steps of assigning a supplemental bingo card to any player in the supplemental game, establishing a bingo ball draw of a predetermined number of bingo numbers, comparing the bingo ball draw against the supplemental bingo cards associated with players and identifying any matches, and awarding a supplemental award to any player whose associated supplemental bingo card includes a predefined interim matching pattern.

In a third aspect of the present invention, a method for providing a supplemental game to a plurality of players is provided. The supplemental game is associated with a main game and is in the form of a bingo game. The method includes the step of establishing a plurality of bingo cards for the supplemental bingo game. Each bingo card has a plurality of columns and a plurality of rows defining a grid having a plurality of locations.

The step of establishing a plurality of bingo cards includes the steps of randomly generating a seed number for each column and establishing a range of numbers for each column. The seed number is an integer. For each column, the method include the steps of randomly selecting a number from a subset of the associated range of numbers of the respective column for each location of the bingo cards and establishing a final number as a function of the associated seed number and the randomly selected number for each location of the respective column and assigning the final number to the location. Each number in the subset of the associated range is used only once in each column. The method further includes the steps of producing the plurality of bingo cards using the final numbers assigned to each location of each bingo card, assigning a supplemental bingo card to any player in the supplemental game, establishing a bingo ball draw of a predetermined number of bingo numbers, comparing the bingo ball draw against the supplemental bingo cards associated with players and identifying any matches, and awarding a supplemental award to any player whose associated supplemental bingo card includes a predefined interim matching pattern.

In a fourth aspect of the present invention, a method for providing a game to a plurality of players. The game includes a main game and a supplemental game. The supplemental game is in the form of a bingo game. The method includes the steps of allowing the players to place a wager on the main game, playing the main game and establishing an outcome of the main game, and awarding one or more players an award as a function of the respective wager and the outcome of the main game. The method includes the step of establishing a plurality of bingo cards for the supplemental bingo game. Each bingo card has a plurality of columns and a plurality of rows defining a grid having a plurality of locations.

The step of establishing a plurality of bingo cards includes the steps of randomly generating a seed number for each column and establishing a range of numbers for each column. The seed number is an integer. For each column, the method include the steps of randomly selecting a number from a subset of the associated range of numbers of the respective column for each location of the bingo cards and establishing a final number as a function of the associated seed number and the randomly selected number for each location of the respective column and assigning the final number to the location. Each number in the subset of the associated range is used only once in each column. The method further includes the steps of producing the plurality of bingo cards using the final numbers assigned to each location of each bingo card, assigning a supplemental bingo card to any player in the supplemental game, establishing a bingo ball draw of a predetermined number of bingo numbers, comparing the bingo ball draw against the supplemental bingo cards associated with players and identifying any matches, and awarding a supplemental award to any player whose associated supplemental bingo card includes a predefined interim matching pattern.

In a fifth aspect of the present invention, a method of establishing a plurality of bingo cards is provided. Each bingo card has a plurality of columns and a plurality of rows defining a grid having a plurality of locations. The method includes the step of randomly generating a seed number for each column. The seed number is an integer and for the respective column is for use across all bingo cards. The method further includes the step of establishing a range of numbers for each column. For each column, performing the steps of randomly selecting a number from a subset of the associated range of numbers of the respective column for each location of the bingo cards and establishing a final number as a function of the associated seed number and the randomly selected number for each location of the respective column and assigning the final number to the location. Each number in the subset of the associated range is used only once in each column. The method further includes the step of producing the plurality of bingo cards using the final numbers assigned to each location of each bingo card.

BRIEF DESCRIPTION OF THE DRAWINGS

FIGS. 3A, 3B, and 3C are exemplary supplemental bingo cards according to an embodiment of the present invention;

DETAILED DESCRIPTION OF THE INVENTION

With reference to the drawings and in operation, the present invention provides a method for providing a game. The game has a main game and a supplemental game.

Figure 1:
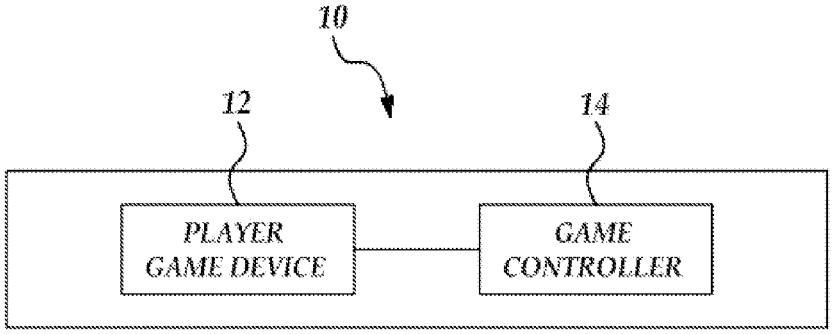
FIG. 1 is block diagram of a game system for providing a game having a main game and a supplemental game, according to an embodiment of the present invention.

In one embodiment, the game is an electronic game and may be played on a game system 10. With particular reference to FIG. 1, the game system 10 includes at least one player game device 12 and a game controller 14. The present invention will now be described in terms of an electronic game system 10, however, it should be noted that the present invention may also be implemented in a non-electronic version.

The player game device 12 allows a player to place a wager. The game controller 14 is coupled to the player game device 12 for playing the main game and establishing an outcome of the main game.

The outcome of the electronic game includes a payout according to a first pay table if a set of predetermined winning conditions has been achieved.

The electronic game may be any type of game which has an outcome and provides a payout. For example, the types of main games may include, but is not limited to, bingo and similar games, slot machines, casino games, card games, dog or horse racing, lotteries, and all other forms of gaming. For purposes of illustration only, the main game of the present invention is described below in terms of bingo, but the present invention is not limited to such.

Figure 2:
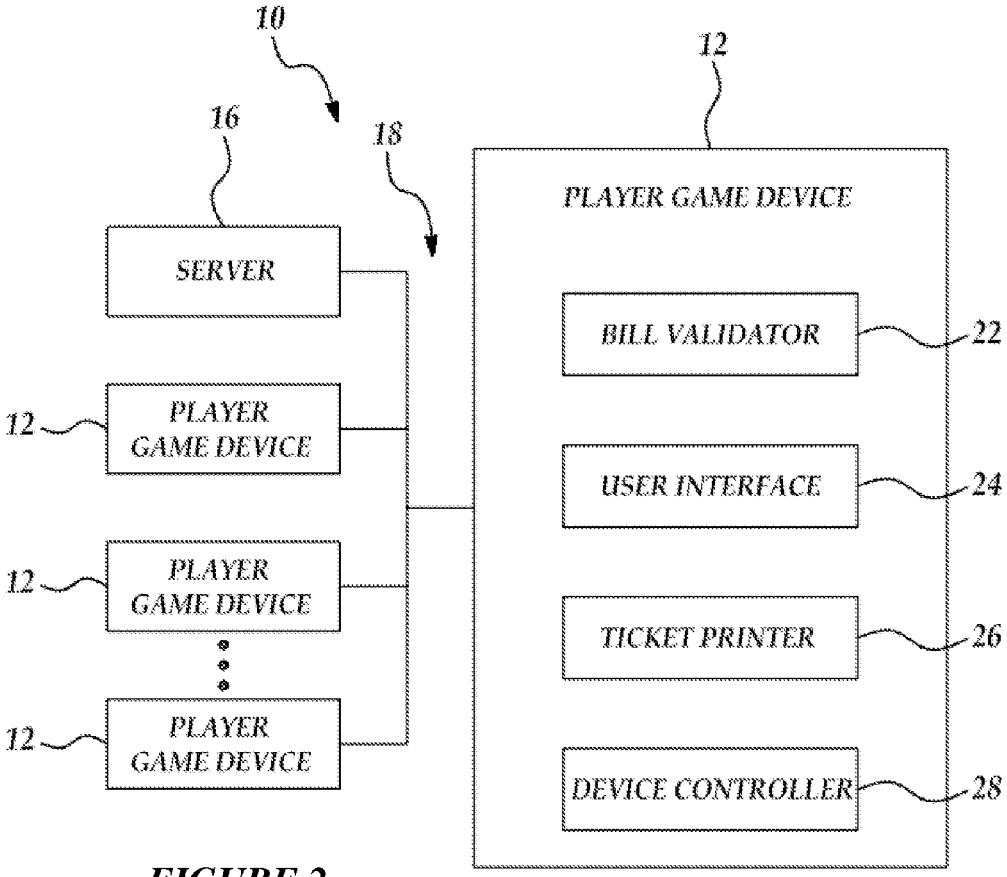
FIG. 2 is a block diagram of a game system for providing a game having a main game and a supplemental game, according to an embodiment of the present invention, according to another embodiment of the present invention.

With particular reference to FIG. 2 in one embodiment, a plurality of player game devices 12 connected to a server 16 are provided. The game controller 14 is implemented by the server 16. Each player device 12 may include a bill validator 22, user interface 24, ticket printer 26, and device controller 28 and may be connected to the server 16 by an Ethernet link 18.

The player game device 12 allows a player to place a wager and purchase an electronic bingo card 20. In one embodiment, the electronic bingo card is a 5×5 grid with the columns labeled B, I, N, G, and O, respectively. The center cell may be a "free" cell.

Each Bingo game has at least one winning pattern. A winning pattern is a sub-set of the cells of the grid which trigger an award or payout. The amount of the award or payout may dependent upon the wager made by the player and a predetermined pay table. In one embodiment, each Bingo game has a game-ending pattern which signifies the end of the game. For example, the game-ending pattern may include all of the cells of the electronic bingo card 20. The payout associated with the game-ending pattern is paid to the first player who achieves the game-ending pattern.

One or more interim winning patterns may also be included. The interim winning patterns may provide a payout, without ending the game, as a function of the player's wager and a second pay table. The interim winning patterns may have other conditions associated therewith. For example, in order for a payout to occur, the interim winning pattern must be achieved within a predetermined number of the randomly drawn numbers.

The game controller or server 14, 14 is coupled to the player game device(s) 12 and establishes a set of chosen numbers. In one embodiment, the set of chosen numbers are randomly chosen using a random number generator (not shown).

It should be noted that the arrangement of the system 10 discussed above is exemplary only.

In one embodiment, there are a predetermined number of numbers in the set of chosen numbers, e.g., seventy-five.

In one embodiment, the predetermined number of numbers in the set of chosen numbers are established within a predetermined period of time, e.g., approximately 10 seconds.

The game controller or server 14, 16 compares the set of randomly chosen numbers with the associated winning pattern and establishing an outcome of the electronic bingo game. The outcome of the electronic bingo game may include a payout according to a first pay table if the winning pattern has been achieved. The winning pattern may be the game ending pattern and/or one or more interim winning patterns. In other words, the outcome of the electronic bingo game may include a payout to the player if the game ending pattern is achieved and, alternatively or in addition, may include a second payout if an interim winning pattern is achieved.

The outcome of the electronic bingo game may be a "loss" if no winning pattern is achieved after all numbers have been selected or another player achieves the game winning pattern.

It should be further noted that the main game disclosed above, i.e., bingo, is exemplary only. The main game can be any number of different types of games. It should be further noted that the main game and the supplementary may be either electronic and/or mechanical/physical.

In one aspect of the present invention, the game also includes a supplemental game in the form of a bingo-type game.

In one embodiment of the present invention, the supplemental bingo game is optional.

In another embodiment of the present invention, the supplemental bingo game is mandatory.

Generally, the supplemental bingo game will require an additional wager, e.g., a supplemental ante, from each player who wants to participate. However, the supplemental game may also be provided as a free game or an award based on a predetermined outcome in the main game.

Once a player has made the supplemental wager (or is otherwise entered into the supplemental game) the player is assigned a supplemental bingo card (see below). In one embodiment, the player may be assigned more than one supplemental bingo card if more than one supplemental wager is placed.

In the present invention, a supplemental award is awarded the players a supplemental award based on a bingo ball draw and the assigned supplemental bingo card. In one embodiment, if the main game is a bingo game, then the same bingo ball draw in the main game may be used for the supplemental bingo game. A supplemental award is awarded to the players when an interim pattern on the supplemental bingo game is achieved In the supplemental bingo game, it is desirable for all of the players (who have made a supplemental wager) to win the supplemental bingo game, i.e., be awarded a supplemental award, simultaneously.

This is accomplished in two ways. First, each column (across all bingo cards used in one supplemental game) includes the same numbers in a random order. Second, the interim patterns for each supplemental game are column based, i.e., the drawn bingo balls must match predetermined one or more full columns of the supplemental bingo cards in order for a supplemental interim pattern to be achieved.

For example, three sample supplemental bingo cards 30A, 30B, 30C are shown in FIGS. 3A, 3B, 3C, respectively. Each column on each card includes the same 5 numbers in a random order: the first column of all three cards 30A, 30B, 30C includes 1-5; the first column of all three cards 30A, 30B, 30C includes 1-5; the second column of all three cards 30A, 30B, 30C includes 16-20; the third column of all three cards 30A, 30B, 30C includes 31-35; the fourth column of all three cards 30A, 30B, 30C includes 46-50; and the fifth column of all three cards 30A, 30B, 30C includes 61-65. The order of the numbers in the columns is, however, random (see below).

Sample interim patterns include, but are not limited to, "fill a column", "fill two columns", and "goalies stripes". Since each column of each card 30A, 30B, 30C includes the same 5 numbers, all players playing the supplemental game would win the interim pattern at the same time.

In one aspect of the present invention, the size or amount of the supplemental award may be a function of the size of the player's wager and the interim pattern achieved. For example, a supplemental award for a given interim pattern may be equal to the wager (whether expressed in currency or credits or by some other measure) multiplied by a predetermined constant.

Figure 4:
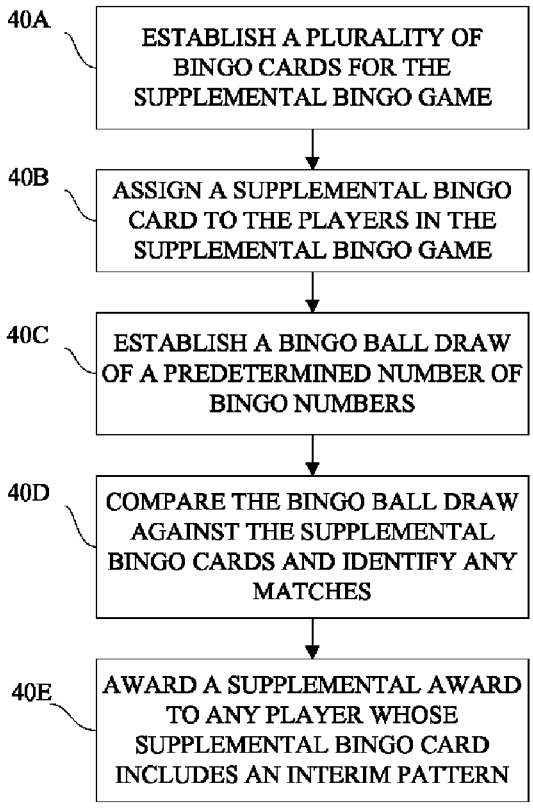
FIG. 4 is a flow diagram of a method for providing a supplemental game, according to an embodiment of the present invention.

With particular reference to FIG. 4, in one aspect of the present invention a method for providing a supplemental game to a plurality of players is provided. The supplemental game is associated with a main game and is in the form of a bingo game. In a first step 40A, a plurality of bingo cards is established for the supplemental bingo game. As shown in FIGS. 3A, 3B, 3C, each bingo card has a plurality of columns and a plurality of rows defining a grid having a plurality of locations. In the illustrated embodiment, each card has five columns and five rows. Each column has an associated letter (B, I, N, G, or O) and each location has an assigned number. As is known in Bingo Games, the drawn Bingo balls have an associated letter and number, e.g., B5.

The number in each column are the same as the numbers in the corresponding columns in the other bingo cards, just arranged in a random order. For example, in the illustrated example, each card 30A, 30B, 30C includes the numbers 1-5 in the first column, just arranged in a random order.

It should be noted, however, that since the order of numbers in a column are randomly determined (see below) it is possible for two cards out of the plurality of cards to have the same order of numbers in at least one column.

In a second step 40B, a supplemental bingo card is assigned to each player who is in the supplemental bingo game. As noted above, players may enter the supplemental game in a variety of ways. For example, entry into the supplemental game may require an additional wager or ante. Alternately, all players may be entered into the supplemental game. The supplemental game may be mandatory or optional. Additionally, a player may win or be awarded entry into the supplemental game as an awarded, e.g., by a particular outcome in the main game.

In a third step 40C a bingo ball draw of a predetermined number, e.g., 75, of bingo numbers is established. In one embodiment, the bingo ball draw is performed by the game controller or server 14, 16. Generally, the Bingo numbers are randomly determined. The Bingo numbers in the Bingo ball draw may be determined previously, i.e., before the Supplementary Bingo Game has begun or during the Supplementary Bingo Game.

In a fourth step 40D, the bingo numbers in the bingo ball draw are compared against the supplemental bingo cards associated with players and any matches are determined.

In the fifth step 40E, a supplemental award is awarded to any player whose associated supplemental bingo card includes a predefined interim matching pattern. The predefined interim match pattern are column based, e.g., fill one column, fill two columns, goalie stripes, etc. . . .

Each individual column has the same numbers as the corresponding columns in the other supplementary bingo cards, for example in the three illustrated cards 30A, 30B, 30C each first column includes numbers 1-5, each second column includes 16-20, each third column includes 31-35, each fourth column includes 46-50, and each fifth column includes 61-65. Thus, since the interim patterns are column-based, every player who is entered in the supplementary bingo game wins a supplementary award (when a column has been filed) at the same time.

As stated above, in the case of an electronic game, the bingo cards are electronic bingo cargo and are produced by storing the numbers assigned to each location of each bingo card in memory.

Alternatively, the supplemental game may utilize physical bingo cards, and thus, the bingo cards are produced by printing the assigned numbers on bingo cards.

In one embodiment, the bingo cards are established in the following manner:

1. A set of numbers for each column is established. Typically, the quantity of numbers in the set of numbers is equal to the number of rows.

2. A number from the set of numbers of the respective column is randomly selected for each location of the bingo cards. Each number in the set of numbers is used only once in each column.

3. The randomly selected numbers are assigned to their respective location.

For example, in the illustrated exemplary bingo cards 30A, 30B, 30C, the set of numbers for the first column includes the numbers 1-5. For each location in each of the first columns of the bingo cards 30A, 30B, 30C, one of the numbers 1-5 is randomly selected for each location, noting the in each column there are no duplicate numbers.

Figure 5:
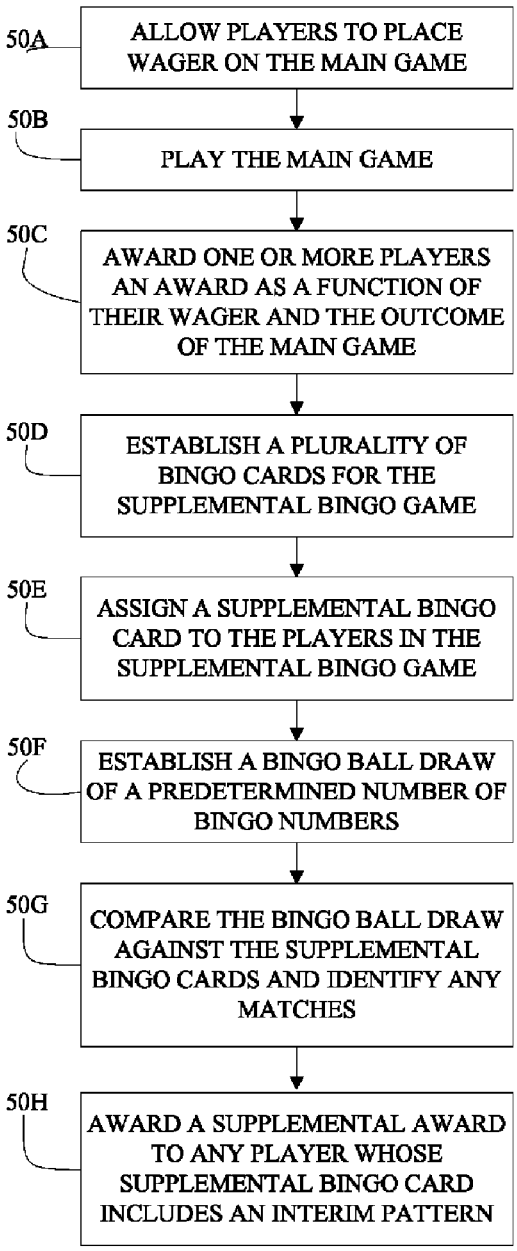
FIG. 5 is a flow diagram of a method for providing a game having a main game and a supplemental game according to an embodiment of the present invention.

With particular reference to FIG. 5, in a second aspect of the present invention, a method for providing a game to a plurality of players is provided. The game includes a main game and a supplemental game, which is in the form of a bingo game.

In a first step 50A, the players are allowed to place a wager on the main game. In a second step 50B, the main game is played and an outcome of the main game is established. In a third step 50C, one or more players is awarded an award as a function of the respective wager and the outcome of the main game.

In a fourth step 50D, a plurality of bingo cards is established for the supplemental bingo game. As shown in FIGS. 3A, 3B, 3C, each bingo card has a plurality of columns and a plurality of rows defining a grid having a plurality of locations. In the illustrated embodiment, each card has five columns and five rows. Each column has an associated letter (B, I, N, G, or O) and each location has an assigned number. As is known in Bingo Games, the drawn Bingo balls have an associated letter and number, e.g., B5.

The number in each column are the same as the numbers in the corresponding columns in the other bingo cards, just arranged in a random order. For example, in the illustrated example, each card 30A, 30B, 30C includes the numbers 1-5 in the first column, just arranged in a random order.

It should be noted, however, that since the order of numbers in a column are randomly determined (see below) it is possible for two cards out of the plurality of cards to have the same order of numbers in at least one column.

In a fifth step 50E, a supplemental bingo card is assigned to each player who is in the supplemental bingo game. As noted above, players may enter the supplemental game in a variety of ways. For example, entry into the supplemental game may require an additional wager or ante. Alternately, all players may be entered into the supplemental game. The supplemental game may be mandatory or optional. Additionally, a player may win or be awarded entry into the supplemental game as an awarded, e.g., by a particular outcome in the main game.

In a sixth step 50F, a bingo ball draw of a predetermined number, e.g., 75, of bingo numbers is established. In one embodiment, the bingo ball draw is performed by the game controller or server 14, 16. Generally, the Bingo numbers are randomly determined. The Bingo numbers in the Bingo ball draw may be determined previously, i.e., before the Supplementary Bingo Game has begun or during the Supplementary Bingo Game.

In a seventh step 50G, the bingo numbers in the bingo ball draw are compared against the supplemental bingo cards associated with players and any matches are determined.

In an eighth step 50H, a supplemental award is awarded to any player whose associated supplemental bingo card includes a predefined interim matching pattern. The predefined interim match pattern are column based, e.g., fill one column, fill two columns, goalie stripes, etc. . . .

Each individual column has the same numbers as the corresponding columns in the other supplementary bingo cards, for example in the three illustrated cards 30A, 30B, 30C each first column includes numbers 1-5, each second column includes 16-20, each third column includes 31-35, each fourth column includes 46-50, and each fifth column includes 61-65. Thus, since the interim patterns are column-based, every player who is entered in the supplementary bingo game wins a supplementary award (when a column has been filed) at the same time.

As stated above, in the case of an electronic game, the bingo cards are electronic bingo cargo and are produced by storing the numbers assigned to each location of each bingo card in memory.

Alternatively, the supplemental game may utilize physical bingo cards, and thus, the bingo cards are produced by printing the assigned numbers on bingo cards.

In one embodiment, the bingo cards are established in the following manner:

1. A set of numbers for each column is established. Typically, the quantity of numbers in each set of numbers is equal to the number of rows.

2. A number from the set of numbers of the respective column is randomly selected for each location of the bingo cards. Each number in the set of numbers is used only once in each column.

3. The randomly selected numbers are assigned to their respective location.

For example, in the illustrated exemplary bingo cards 30A, 30B, 30C, the set of numbers for the first column includes the numbers 1-5. For each location in each of the first columns of the bingo cards 30A, 30B, 30C, one of the numbers 1-5 is randomly selected for each location, noting the in each column there are no duplicate numbers.

Figure 6:
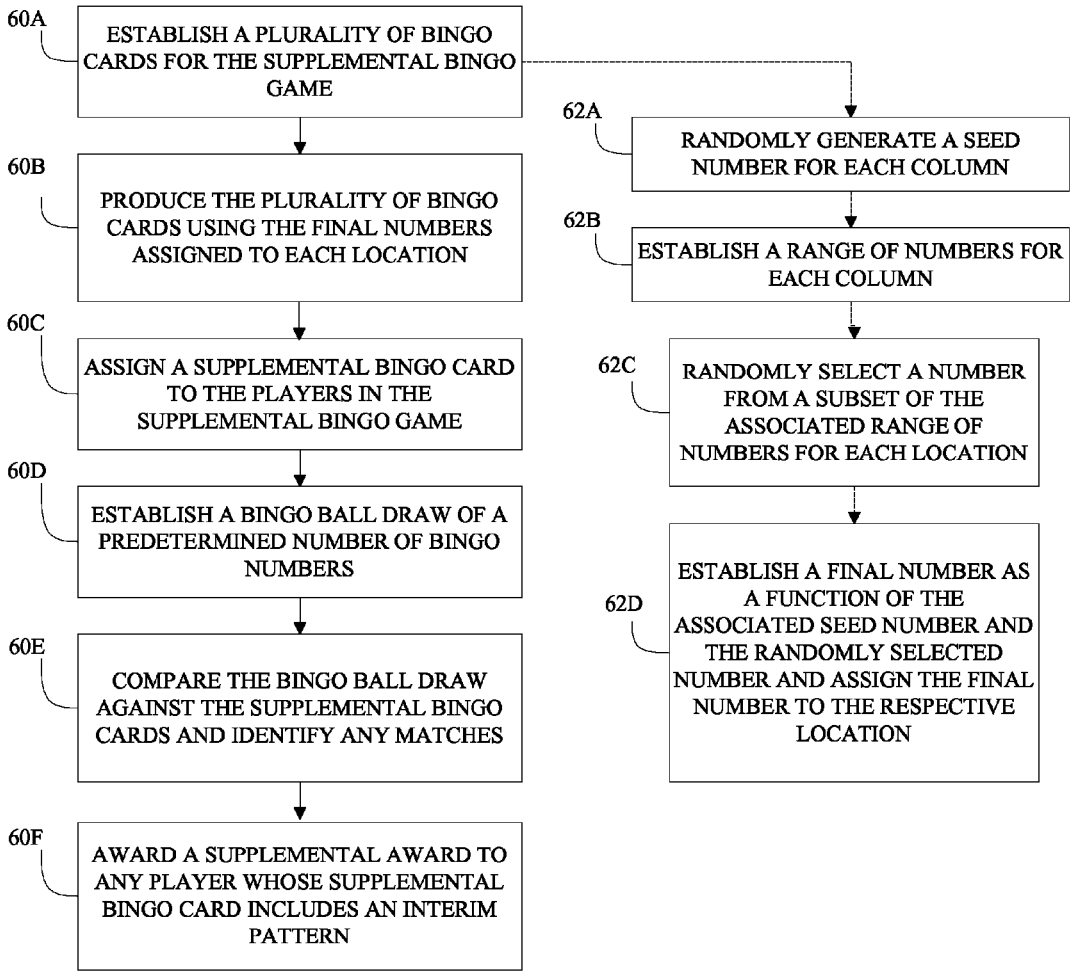
FIG. 6 is a flow diagram of a second method for providing a supplemental game, according to an embodiment of the present invention.

With particular reference to FIG. 6, in a third aspect of the present invention, a method for providing a supplemental game to a plurality of players is provided. The supplemental game is associated with a main game and is in the form of a bingo game. In a first step 60A, a plurality of bingo cards for the supplemental bingo game are established. Each bingo card has a plurality of columns and a plurality of rows defining a grid having a plurality of locations. The first step includes four sub-steps 62A, 62B, 62C, 62D.

In the first sub-step 62A, a seed number for each column is randomly generated. In one embodiment, the generated seed number is an integer and is used for a respective column across all of the bingo cards.

In a second sub-step 62B, a range of numbers for each column is established.

For each column, sub-steps 62C and 62D are performed. In the third sub-step 62C, a number from a subset of the associated range of numbers of the respective column is randomly selected for each location of the bingo cards. Each number in the subset of the associated range is used only once in each column.

In the fourth sub-step 62D, a final number is established as a function of the associated seed number and the randomly selected number for each location of the respective column and assigned the final number to the location. In one embodiment of the present invention, the final number is established by adding the seed number and the randomly selected number together. However, it should be noted that other mathematical operations or formulas may be used, e.g., subtraction, multiplication, or division.

Returning to the main flow diagram, the plurality of bingo cards are produced using the final numbers assigned to each location of each bingo card in a second step 60B.

In a third step 60C, a supplemental bingo card is assigned to each player who is in the supplemental bingo game. As noted above, players may enter the supplemental game in a variety of ways. For example, entry into the supplemental game may require an additional wager or ante. Alternately, all players may be entered into the supplemental game. The supplemental game may be mandatory or optional. Additionally, a player may win or be awarded entry into the supplemental game as an awarded, e.g., by a particular outcome in the main game.

In a fourth step 60D, a bingo ball draw of a predetermined number, e.g., 75, of bingo numbers is established. In one embodiment, the bingo ball draw is performed by the game controller or server 14, 16. Generally, the Bingo numbers are randomly determined. The Bingo numbers in the Bingo ball draw may be determined previously, i.e., before the Supplementary Bingo Game has begun or during the Supplementary Bingo Game.

In a fifth step 60E, the bingo numbers in the bingo ball draw are compared against the supplemental bingo cards associated with players and any matches are determined.

In a sixth step 60F, a supplemental award is awarded to any player whose associated supplemental bingo card includes a predefined interim matching pattern. The predefined interim match pattern are column based, e.g., fill one column, fill two columns, goalie stripes, etc. . . .

Each individual column has the same numbers as the corresponding columns in the other supplementary bingo cards, for example in the three illustrated cards 30A, 30B, 30C each first column includes numbers 1-5, each second column includes 16-20, each third column includes 31-35, each fourth column includes 46-50, and each fifth column includes 61-65. Thus, since the interim patterns are column-based, every player who is entered in the supplementary bingo game wins a supplementary award (when a column has been filed) at the same time.

As stated above, in the case of an electronic game, the bingo cards are electronic bingo cargo and are produced by storing the numbers assigned to each location of each bingo card in memory.

Alternatively, the supplemental game may utilize physical bingo cards, and thus, the bingo cards are produced by printing the assigned numbers on bingo cards.

In one illustrative example, the range of numbers for a first column are 1-15, the range of numbers for a second column are 16-30, the range of numbers for a third column are 31-45, the range of numbers for a fourth column are 46-60, and the range of numbers for a fifth column are 61-75. The seed number may be randomly chosen from the range of 0-10. And the subset of each range includes the first numbers in reach range, i.e., 1-5; 16-30; 31-35; 46-60; and 61-75, respectively.

For example, with respect to the first column of the supplemental bingo card 30C of FIG. 3C, the range of numbers for the first column are 1-15 and the subset of the range is 1-5. In the illustrated embodiment, the randomly selected seed number is 0. In this embodiment, the final numbers is established by adding the seed number and the randomly selected number. Thus, the final numbers in the first column, which are in random order, are 4, 2, 1, 5, 3.

With a given range of seed numbers from 0-10, the final numbers for the other seed numbers would be:

| Seed # | 1 | 2 | 3 | 4 | 5 | 6 | 7 | 8 | 9 | 10 |
|---|---|---|---|---|---|---|---|---|---|---|
| 1st Column | 5 | 6 | 7 | 8 | 9 | 10 | 11 | 12 | 13 | 14 |
| 2nd Column | 3 | 4 | 5 | 6 | 7 | 8 | 9 | 10 | 11 | 12 |
| 3rd Column | 2 | 3 | 4 | 5 | 6 | 7 | 8 | 9 | 10 | 11 |
| 4th Column | 6 | 7 | 8 | 9 | 10 | 11 | 12 | 13 | 14 | 15 |
| 5th Column | 4 | 5 | 6 | 7 | 8 | 9 | 10 | 11 | 12 | 13 |

It should be noted, however, that in another embodiment, final numbers could "wrap around". For example, if the range of seed numbers went to 11, then the final numbers for the first column above would be 15, 12, 11, 1, 13.

It should also be noted that in the illustrated embodiment the ranges of number across the columns do not overlap. However, in other embodiment the ranges may overlap.

Figure 7:
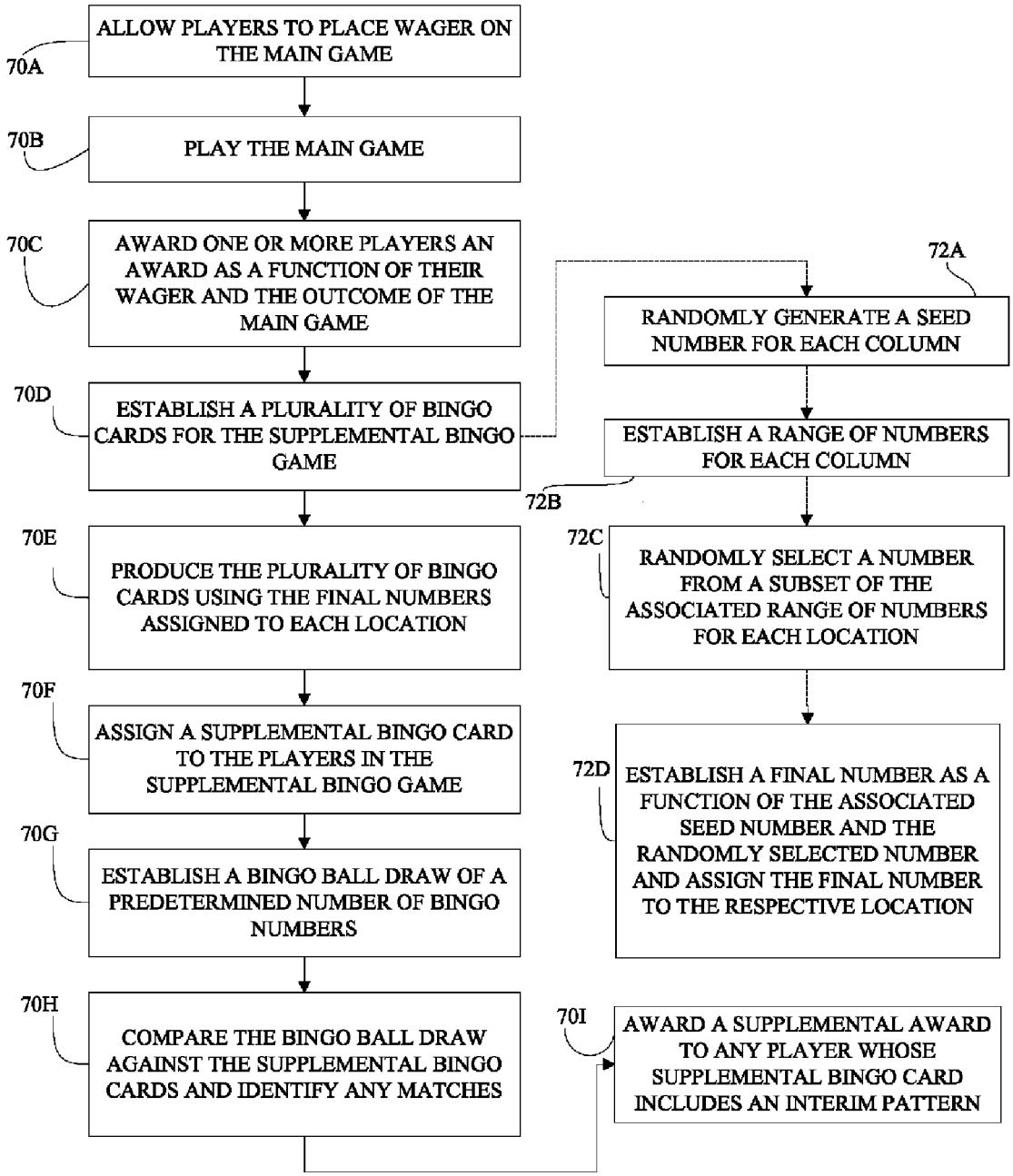
FIG. 7 is a flow diagram of a second method for providing a game having a main game and a supplemental game according to an embodiment of the present invention; and, FIG. 8 is a flow diagram of a method for establishing a plurality of bingo cards, according to an embodiment of the present invention.

With particular reference to FIG. 7, in a fourth aspect of the present invention, a method for providing a game to a plurality of players is provided. The game includes a main game and a supplemental game, which is in the form of a bingo game.

In a first step 70A, the players are allowed to place a wager on the main game. In a second step 70B, the main game is played and an outcome of the main game is established. In a third step 70C, one or more players is awarded an award as a function of the respective wager and the outcome of the main game.

In a fourth step 70D, a plurality of bingo cards for the supplemental bingo game are established. Each bingo card has a plurality of columns and a plurality of rows defining a grid having a plurality of locations. The first step includes four sub-steps 72A, 72B, 72C, 72D.

In the first sub-step 72A, a seed number for each column is randomly generated. In one embodiment, the generated seed number is an integer and is used for a respective column across all of the bingo cards.

In a second sub-step 72B, a range of numbers for each column is established.

For each column, sub-steps 72C and 72D are performed. In the third sub-step 72C, a number from a subset of the associated range of numbers of the respective column is randomly selected for each location of the bingo cards. Each number in the subset of the associated range is used only once in each column.

In the fourth sub-step 72D, a final number is established as a function of the associated seed number and the randomly selected number for each location of the respective column and assigned the final number to the location. In one embodiment of the present invention, the final number is established by adding the seed number and the randomly selected number together. However, it should be noted that other mathematical operations or formulas may be used, e.g., subtraction, multiplication, or division.

Returning to the main flow diagram, the plurality of bingo cards are produced using the final numbers assigned to each location of each bingo card in a fifth step 70E.

In a sixth step 70F, a supplemental bingo card is assigned to each player who is in the supplemental bingo game. As noted above, players may enter the supplemental game in a variety of ways. For example, entry into the supplemental game may require an additional wager or ante. Alternately, all players may be entered into the supplemental game. The supplemental game may be mandatory or optional. Additionally, a player may win or be awarded entry into the supplemental game as an awarded, e.g., by a particular outcome in the main game.

In a seventh step 70G, a bingo ball draw of a predetermined number, e.g., 75, of bingo numbers is established. In one embodiment, the bingo ball draw is performed by the game controller or server 14, 16. Generally, the Bingo numbers are randomly determined. The Bingo numbers in the Bingo ball draw may be determined previously, i.e., before the Supplementary Bingo Game has begun or during the Supplementary Bingo Game.

In an eighth step 70H, the bingo numbers in the bingo ball draw are compared against the supplemental bingo cards associated with players and any matches are determined.

In a ninth step 70I, a supplemental award is awarded to any player whose associated supplemental bingo card includes a predefined interim matching pattern. The predefined interim match pattern are column based, e.g., fill one column, fill two columns, goalie stripes, etc. . . .

Figure 8:
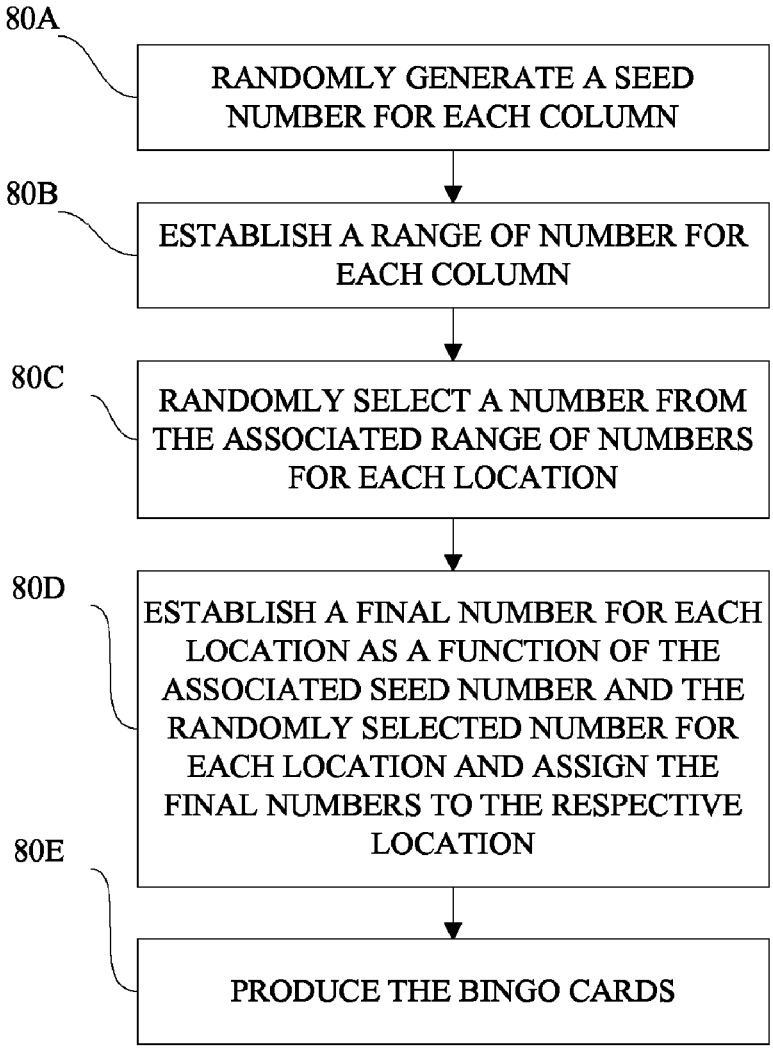

With particular reference to FIG. 8, in a fifth aspect of the present invention a method of establishing a plurality of bingo cards is established. The bingo cards may be electronic or physical bingo cards.

In a first step 80A, a seed number for each column is randomly generated. In one embodiment, the generated seed number is an integer and is used for a respective column across all of the bingo cards.

In a second step 80B, a range of numbers for each column is established.

For each column, steps 80C and 80D are performed. In the third step 80C, a number from a subset of the associated range of numbers of the respective column is randomly selected for each location of the bingo cards. Each number in the subset of the associated range is used only once in each column.

In the fourth step 80D, a final number is established as a function of the associated seed number and the randomly selected number for each location of the respective column and assigned the final number to the location. In one embodiment of the present invention, the final number is established by adding the seed number and the randomly selected number together. However, it should be noted that other mathematical operations or formulas may be used, e.g., subtraction, multiplication, or division.

The plurality of bingo cards are produced using the final numbers assigned to each location of each bingo card in a fifth step 80E.

The present invention has been described herein in an illustrative manner, and it is to be understood that the terminology which has been used is intended to be in the nature of words of description rather than of limitation. Obviously, many modifications and variations of the invention are possible in light of the above teachings. The invention may be practiced otherwise than as specifically described within the scope of the appended claims.

What is claimed is:

1. A method for providing a supplemental electronic game to a plurality of players, the supplemental game being associated with a main game, the supplemental game being in the form of a bingo game, comprising:

establishing, by a game controller, a plurality of bingo cards for the supplemental bingo game, each bingo card having a predetermined number of columns and a predetermined number of rows defining a grid having a plurality of locations, each location having an assigned number, for each column across the plurality of bingo cards the game controller performing the steps of:

(a) establishing a set of numbers, the number of numbers in the set of numbers being equal to the number of rows; and, (b) randomly assigning one of the numbers from the set of numbers to each location in the associated column, each number being used only once in each column, the numbers in each column being the same as the corresponding columns in the other bingo cards arranged in a random order;

assigning, by the game controller, a supplemental bingo card to any player in the supplemental game;

establishing, by the game controller, a bingo ball draw of a predetermined number of bingo numbers;

comparing, by the game controller, the bingo ball draw against the supplemental bingo cards associated with players and identifying any matches; and, awarding, by the game controller, a supplemental award to any player whose associated supplemental bingo card includes a predefined interim matching pattern, the predefined interim match pattern being column based.

2. A method, as set forth in claim 1, wherein the step of producing the plurality of bingo cards includes the step of storing the numbers assigned to each location of each bingo card in memory.

3. A method, as set forth in claim 1, wherein the bingo cards are physical bingo cards, and the step of producing the plurality of bingo cards includes the step of printing the numbers assigned to each location on physical bingo cards.

4. A method, as set forth in claim 1, wherein the bingo cards have five columns and five rows.

5. A method, as set forth in claim 4, wherein the range of numbers for each column do not overlap.

6. A method, as set forth in claim 1, wherein the main game is a bingo game.

7. A method, as set forth in claim 1, wherein the step of establishing a plurality of bingo cards includes the steps of:

establishing a set of numbers for each column, the quantity of numbers in each set of numbers being equal to the number of rows;

randomly selecting a number from the set of numbers of the respective column for each location of the bingo cards, each number in the set of numbers being used only once in each column; and, assigning the randomly selected number to the respective location; and the method includes the step of producing the plurality of bingo cards as a function of the randomly selected number assigned to each location of each bingo card.

8. A method, as set forth in claim 1, including the step of allowing the players to make a wager on the supplemental game, wherein the amount of any supplemental award is a function of the wager.

9. A method for providing an electronic game to a plurality of players, the game including a main game and a supplemental game, the supplemental game being in the form of a bingo game, comprising:

allowing the players to place a wager on the main game;

playing, by a game controller, the main game and establishing an outcome of the main game;

awarding one or more players an award as a function of the respective wager and the outcome of the main game;

establishing, by the game controller, a plurality of bingo cards for the supplemental bingo game, each bingo card having a predetermined number of columns and a predetermined number of rows defining a grid having a plurality of locations, each location having an assigned number, for each column across the plurality of bingo cards the game controller performing the steps of:

(a) establishing a set of numbers, the number of numbers in the set of numbers being equal to the number of rows; and, (b) randomly assigning one of the numbers from the set of numbers to each location in the associated column, each number being used only once in each column, the numbers in each column being the same as the corresponding columns in the other bingo cards arranged in a random order;

assigning a supplemental bingo card to any player in the supplemental game;

establishing a bingo ball draw of a predetermined number of bingo numbers;

comparing the bingo ball draw against the supplemental bingo cards associated with players and identifying any matches; and, awarding a supplemental award to any player whose associated supplemental bingo card includes a predefined interim matching pattern.

10. A method, as set forth in claim 9, wherein the step of producing the plurality of bingo cards includes the step of storing the numbers assigned to each location of each bingo card in memory.

11. A method, as set forth in claim 9, wherein the bingo cards are physical bingo cards, and the step of producing the plurality of bingo cards includes the step of printing the numbers assigned to each location on physical bingo cards.

12. A method, as set forth in claim 9, wherein the bingo cards have five columns and five rows.

13. A method, as set forth in claim 12, wherein the range of numbers for each column do not overlap.

14. A method, as set forth in claim 9, wherein the main game is a bingo game.

15. A method, as set forth in claim 9, wherein the step of establishing a plurality of bingo cards includes the steps of:

establishing a set of numbers for each column, the quantity of numbers in each set of numbers being equal to the number of rows;

randomly selecting a number from the set of numbers subset of the associated range of numbers of the respective column for each location of the bingo cards, each number in the set of numbers being used only once in each column; and, assigning the randomly selected number to the respective location; and the method includes the step of producing the plurality of bingo cards as a function of the randomly selected number assigned to each location of each bingo card.

16. A method, as set forth in claim 9, including the step of allowing the players to make a wager on the supplemental game, wherein the amount of any supplemental award is a function of the wager.

17. A method for providing a supplemental electronic game to a plurality of players, the supplemental game being associated with a main game, the supplemental game being in the form of a bingo game, comprising:

establishing, by a game controller, a plurality of bingo cards for the supplemental bingo game, each bingo card having a predetermined number plurality of columns and a predetermined number plurality of rows defining a grid having a plurality of locations, the step of establishing a plurality of bingo cards including:

randomly generating a seed number for each column, the seed number being an integer, the seed number for the respective column for use across all bingo cards;

establishing a range of numbers for each column; and, for each column, the game controller performing the steps of: randomly selecting a number from a subset of the associated range of numbers of the respective column for each location of the bingo cards, the number of numbers in the subset of numbers being equal to the number of rows, each number in the subset of the associated range being used only once in each column; and, establishing a final number as a function of the associated seed number and the randomly selected number for each location of the respective column and assigning the final number to the location;

producing the plurality of bingo cards using the final numbers assigned to each location of each bingo card, the final numbers in each column being the same as the corresponding column in tile other bingo cards arranged in a random order;

assigning a supplemental bingo card to any player in the supplemental game;

establishing, by the game controller, a bingo ball draw of a predetermined number of bingo numbers;

comparing, by the game controller, the bingo ball draw against the supplemental bingo cards associated with players and identifying any matches; and, awarding a supplemental award to any player whose associated supplemental bingo card includes a predefined interim matching pattern.

18. A method, as set forth in claim 17, wherein the step of producing the plurality of bingo cards includes the step of storing the final number assigned to each location of each bingo card in memory.

19. A method, as set forth in claim 17, wherein the bingo cards are physical bingo cards, and the step of producing the plurality of bingo cards includes the step of printing the final number assigned to each location on physical bingo cards.

20. A method, as set forth in claim 17, wherein the bingo cards have five columns and five rows.

21. A method, as set forth in claim 20, wherein the range of numbers for each column do not overlap.

22. A method, as set forth in claim 21, wherein the range of numbers for a first column are 1-15, the range of numbers for a second column are 16-30, the range of numbers for a third column are 31-45, the range of numbers for a fourth column are 46-60, and the range of numbers for a fifth column are 61-75.

23. A method, as set forth in claim 22, wherein the subset of each range includes the first five numbers in each range.

24. A method, as set forth in claim 23, wherein the seed number is randomly selected from a group of integers consisting of 0-10.

25. A method, as set forth in claim 17, wherein the main game is a bingo game.

26. A method, as set forth in claim 17, wherein the at least one interim pattern is column based.

27. A method, as set forth in claim 17, wherein the step of establishing a final number includes the step of adding the seed number to the randomly selected number to establish the final number.

28. A method, as set forth in claim 17, including the step of allowing the players to make a wager on the supplemental game, wherein the amount of any supplemental award is a function of the wager.

29. A method for providing a game to a plurality of players, the game including a main game and a supplemental game, the supplemental game being in the form of a bingo game, comprising:

allowing the players to place a wager on the main game; playing, by a game controller, the main game and establishing an outcome of the main game;

awarding one or more players an award as a function of the respective wager and the outcome of the main game;

establishing, by the game controller, a plurality of bingo cards for the supplemental bingo game, each bingo card having a predetermined number plurality of columns and a predetermined number plurality of rows defining a grid having a plurality of locations, the step of establishing a plurality of bingo cards including:

randomly generating a seed number for each column, the seed number being an integer, the seed number for the respective column for use across all bingo cards; and, establishing a range of numbers for each column;

for each column, the game controller performing the steps of:

randomly selecting a number from a subset of the associated range of numbers of the respective column for each location of the bingo cards, the number of numbers in the subset of numbers being equal to the number of rows, each number in the subset of the associated range being used only once in each column; and, establishing a final number as a function of the associated seed number and the randomly selected number for each location of the respective column and assigning the final number to the location;

producing the plurality of bingo cards using the final numbers assigned to each location of each bingo card, the final numbers in each column being the same as the corresponding column in the other bingo cards arranged in random order;

assigning a supplemental bingo card to any player in the supplemental game;

establishing, by the game controller, a bingo ball draw of a predetermined number of bingo numbers;

comparing, by the game controller, the bingo ball draw against the supplemental bingo cards associated with players and identifying any matches; and, awarding a supplemental award to any player whose associated supplemental bingo card includes a predefined interim matching pattern.

30. A method, as set forth in claim 29, wherein the step of producing the plurality of bingo cards includes the step of storing the final number assigned to each location of each bingo card in memory.

31. A method, as set forth in claim 29, wherein the bingo cards are physical bingo cards, and the step of producing the plurality of bingo cards includes the step of printing the final number assigned to each location on physical bingo cards.

32. A method, as set forth in claim 29, wherein the bingo cards have five columns and five rows.

33. A method, as set forth in claim 32, wherein the range of numbers for each column do not overlap.

34. A method, as set forth in claim 33, wherein the range of numbers for a first column are 1-15, the range of numbers for a second column are 16-30, the range of numbers for a third column are 31-45, the range of numbers for a fourth column are 46-60, and the range of numbers for a fifth column are 61-75.

35. A method, as set forth in claim 34, wherein the subset of each range includes the first five numbers in each range.

36. A method, as set forth in claim 35, wherein the seed number is randomly selected from a group of integers consisting of 0-10.

37. A method, as set forth in claim 29, wherein the main game is a bingo game.

38. A method, as set forth in claim 29, wherein the at least one interim pattern is column based.

39. A method, as set forth in claim 29, wherein the step of establishing a final number includes the step of adding the seed number to the randomly selected number to establish the final number.

40. A method, as set forth in claim 29, including the step of allowing the players to make a wager on the supplemental game, wherein the amount of any supplemental award is a function of the wager.

41. A method of establishing a plurality of bingo cards, each bingo card having a predetermined number of columns and a predetermined number of rows defining a grid having a plurality of locations, comprising:

randomly generating, by a game controller, a seed number for each column, the seed number being an integer, the seed number for the respective column for use across all bingo cards;

establishing, by the game controller, a range of numbers for each column; for each column, the game controller performing the steps of:

randomly selecting a number from a subset of the associated range of numbers of the respective column for each location of the bingo cards, the number of numbers in the subset of numbers being equal to the number of rows, each number in the subset of the associated range being used only once in each column; and, establishing a final number as a function of the associated seed number and the randomly selected number for each location of the respective column and assigning the final number to the location; and, producing the plurality of bingo cards using the final numbers assigned to each location of each bingo card, the final numbers in each column being the same as the corresponding column in the other bingo cards arranged in a random order.

42. A method, as set forth in claim 41, wherein the bingo cards are used in a supplemental electronic bingo game and are electronic bingo cards and the step of producing the plurality of bingo cards includes the step of storing the final number assigned to each location of each bingo card in memory.

43. A method, as set forth in claim 41, wherein the bingo cards are physical bingo cards, and the step of producing the plurality of bingo cards includes the step of printing the final number assigned to each location on physical bingo cards.

44. A method, as set forth in claim 41, wherein the bingo cards have five columns and five rows.

45. A method, as set forth in claim 41, wherein the range of numbers for each column do not overlap.

46. A method, as set forth in claim 45, wherein the range of numbers for a first column are 1-15, the range of numbers for a second column are 16-30, the range of numbers for a third column are 31-45, the range of numbers for a fourth column are 46-60, and the range of numbers for a fifth column are 61-75.

47. A method, as set forth in claim 46, wherein the subset of each range includes the first five numbers in each range.

48. A method, as set forth in claim 41, wherein the seed number is randomly selected from a group of integers consisting of 0-10.

* * * * *